US010408503B2

(12) United States Patent
Assaf

(10) Patent No.: US 10,408,503 B2
(45) Date of Patent: Sep. 10, 2019

(54) HEAT PUMP SYSTEM AND METHOD FOR AIR CONDITIONING

(71) Applicant: Agam Energy Systems Ltd., Hod Hasharon (IL)

(72) Inventor: Gad Assaf, Beer Sheva (IL)

(73) Assignee: Agam Energy Systems Ltd., Hod Hasharon (IL)

( * ) Notice: Subject to any disclaimer, the term of this patent is extended or adjusted under 35 U.S.C. 154(b) by 325 days.

(21) Appl. No.: 15/346,216

(22) Filed: Nov. 8, 2016

(65) Prior Publication Data

US 2018/0128517 A1 May 10, 2018

(51) Int. Cl.

| | |
|---|---|
| ***F25B 13/00*** | (2006.01) |
| ***F25B 41/00*** | (2006.01) |
| ***F25B 30/02*** | (2006.01) |
| ***F24F 3/14*** | (2006.01) |
| ***F24F 5/00*** | (2006.01) |
| ***F25B 25/00*** | (2006.01) |

(52) U.S. Cl.

CPC ..... *F25B 13/00* (2013.01); *F24F 3/1411* (2013.01); *F24F 3/1417* (2013.01); *F24F 5/0014* (2013.01); *F25B 25/005* (2013.01); *F25B 30/02* (2013.01); *F25B 41/003* (2013.01); *F24F 2003/1458* (2013.01); *F25B 2339/047* (2013.01)

(58) Field of Classification Search

CPC ..... F25B 25/005; F24F 3/1411; F24F 5/0014

See application file for complete search history.

(56) References Cited

U.S. PATENT DOCUMENTS

| | | | | |
|---|---|---|---|---|
| 2,269,053 | A | 1/1942 | Crawford | |
| 4,941,324 | A | 7/1990 | Peterson | |
| 5,297,398 | A * | 3/1994 | Meckler | B01D 53/261 62/271 |

(Continued)

FOREIGN PATENT DOCUMENTS

| | | | |
|---|---|---|---|
| EP | 0824659 | A1 | 2/1998 |
| GB | 2042713 | A | 9/1980 |
| WO | WO 2013/054322 | A1 | 4/2013 |

OTHER PUBLICATIONS

International Search Report and Written Opinion of International Searching Authority for Application No. PCT/IB2017/056877, dated Jan. 26, 2018 (13 pages).

*Primary Examiner* — Elizabeth J Martin

(74) *Attorney, Agent, or Firm* — Nixon Peabody LLP; Justin D. Swindells

(57) ABSTRACT

A heat pump system comprises two units in fluid communication with each other, with each unit including a housing containing an air/brine heat exchanger that includes a direct contact air/brine heat exchanger pad. A brine inlet in the housing supplies liquid brine to the upper end of the air/brine heat exchanger so that the brine flows downwardly through the heat exchanger pad. An air inlet in the housing directs ambient air into the heat exchanger pad in a direction transverse to the flow of brine through the pad, and an air outlet discharges the air from the housing. A brine reservoir receives brine passed through the air/brine heat exchanger. A pair of brine/refrigerant heat exchangers is coupled to the brine reservoirs, for receiving brine from the reservoirs, and coupled to the brine inlets of different ones of the housings, and a refrigerant supply supplies refrigerant to the brine/refrigerant heat exchangers.

16 Claims, 2 Drawing Sheets

(56) References Cited

U.S. PATENT DOCUMENTS

| | | | |
|---|---|---|---|
| 6,266,975 | B1 | 7/2001 | Assaf |
| RE39,288 | E | 9/2006 | Assaf |
| 2004/0261354 | A1 | 12/2004 | Gigola |

* cited by examiner

HEAT PUMP SYSTEM AND METHOD FOR AIR CONDITIONING

FIELD OF THE INVENTION

The present invention relates generally to heat pump systems and, more particularly, to a heat pump system utilizing brine, a refrigerant and ambient air. The invention also relates to a method of air conditioning, utilizing the heat pump system.

BACKGROUND

Space heating and cooling systems typically include a refrigerant circulated by a compressor through finned pipes located inside and outside a building. In winter, the compressor forces compressed and warmed refrigerant into finned pipe sections within the house where condensation takes place. The liberated heat is usually dispensed into the house by means of a fan. The condensed refrigerant then passes through a throttle valve to an evaporator. The heat of evaporation is provided by the colder outside air. During summer, the sense of circulation of the refrigerant is reversed. The outside finned pipes constitute the condenser, while the inside finned pipes operate as the evaporator.

SUMMARY

In one embodiment, a heat pump system includes two units in fluid communication with each other, with each unit including a housing containing an air/brine heat exchanger that includes a direct contact air/brine heat exchanger pad. A brine inlet in the housing supplies liquid brine to the upper end of the air/brine heat exchanger so that the brine flows downwardly through the heat exchanger pad. An air inlet in the housing directs ambient air into the heat exchanger pad in a direction transverse to the flow of brine through the pad, and an air outlet receives air passed through the heat exchanger pad and discharges the air from the housing. A brine reservoir receives brine passed through the air/brine heat exchanger, and two brine/refrigerant heat exchangers are coupled to the brine reservoirs for receiving brine from the reservoirs. The brine/refrigerant heat exchangers are coupled to the brine inlets of different ones of the housings, and a refrigerant supply is coupled to the brine/refrigerant heat exchangers for supplying refrigerant to the brine/refrigerant heat exchangers.

In a preferred embodiment, each of the housings includes an exhaust fan for drawing ambient air through the direct contact air/brine heat exchanger in that housing, refrigerant supply lines are coupled to the brine/refrigerant heat exchangers for supplying refrigerant to those heat exchangers, and a pair of brine pumps are coupled to different ones of the brine reservoirs for supplying brine to the brine/refrigerant heat exchangers. The direct contact air/brine heat exchanger pads are preferably porous pads that are wetted by brine flowing through the pads, and are permeable to air that is drawn or forced through the pads, to provide intimate contact between the brine and the air.

The invention further provides a heat pump method for controlling the temperature and humidity of the air in an enclosure. The method supplies liquid brine to the upper end of a first direct contact air/brine heat exchanger within a first housing located in the enclosure, so that the brine flows downwardly through the first heat exchanger pad. Ambient air is directed ambient air in the enclosure into the first heat exchanger pad in a direction transverse to the flow of brine through the pad, discharging air passed through the heat exchanger pad from the housing into the space within the enclosure, and receiving brine passed through the first air/brine heat exchanger in a first brine reservoir within the first housing. The method also supplies liquid brine to the upper end of a second direct contact air/brine heat exchanger within a second housing located outside the enclosure, so that the brine flows downwardly through the second heat exchanger pad, directing ambient air from outside the enclosure into the second heat exchanger pad in a direction transverse to the flow of brine through the pad, discharging air passed through the second heat exchanger pad from the housing into the space outside the enclosure, and receiving brine passed through the second air/brine heat exchanger in a second brine reservoir within the second housing.

Hygroscopic brine such as LiBr, $MgCl_2$, $CaCl_2$ and mixtures thereof, can be advantageously used. The concentrations of these brines are such that no precipitation of salts or ice occurs throughout the working temperature range of the heat pump.

DETAILED DESCRIPTION

Figure 1:
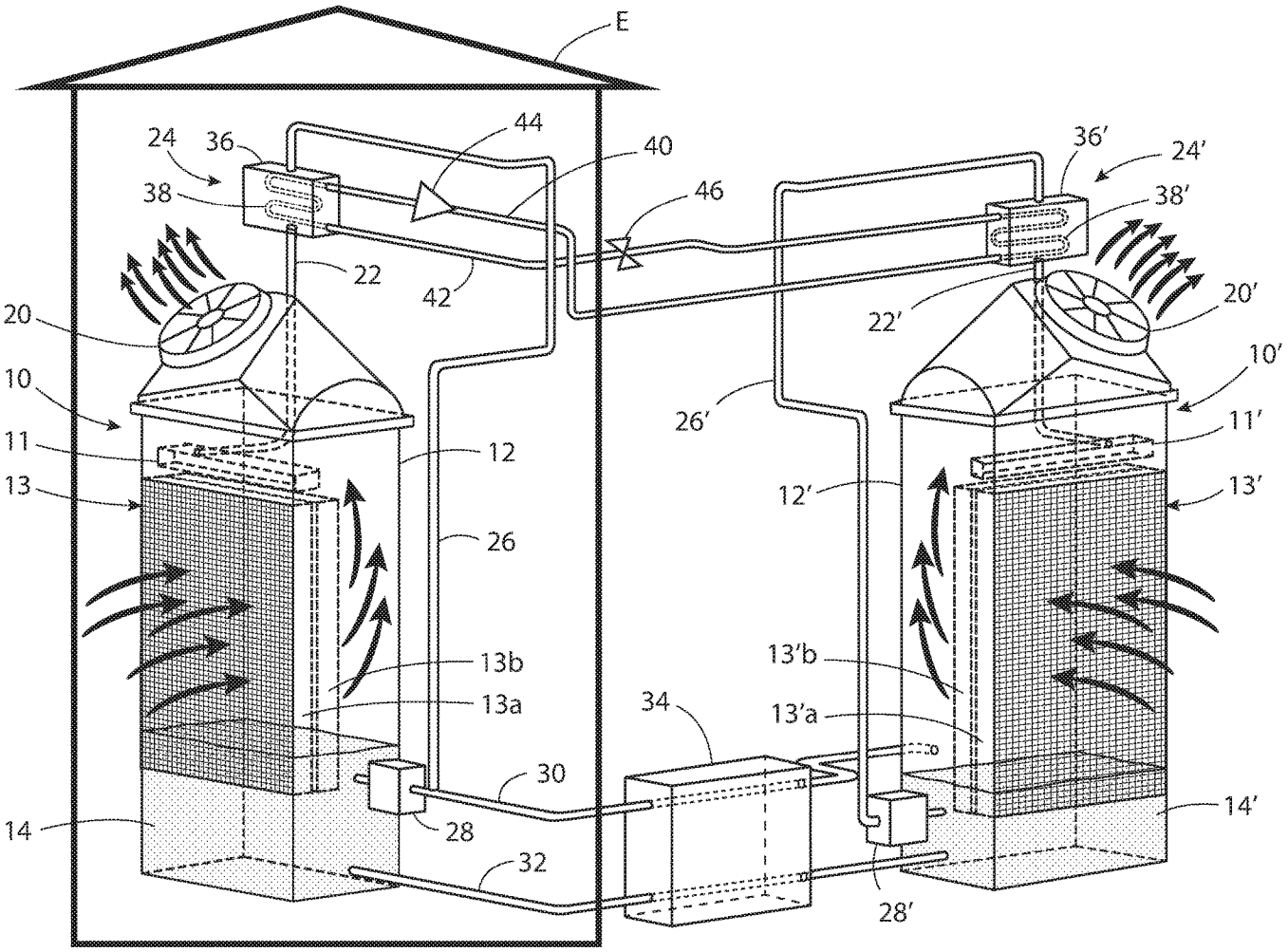
FIG. 1 is a schematic diagram of a heat pump system utilizing brine and refrigerant.

In the exemplary embodiment illustrated in FIG. 1, a heat pump system includes two substantially similar units 10 and 10' acting as an evaporator and a condenser, respectively. The unit 10 is located inside an enclosure E to be air conditioned, and the unit 10' is located outside the enclosure E. A heat exchanger 12 reduces the temperature and moisture content of the incoming air in the unit 10, so that air exhausted from the unit 10 is cooler than the ambient air inside the enclosure E being air conditioned.

The heat exchanger 12' in the second unit 10' increases the temperature of the air that is exhausted from the unit 10', and thus the air supply for the enclosure E can be switched to the unit 12' when it is desired to heat, rather than cool, the air inside the enclosure E. That is, air from the unit 10 can be supplied to the enclosure E during the summer, and air from the unit 10' can be supplied to the enclosure E during the winter.

Each of the units 10 and 10' includes a housing 12 or 12' containing an air/brine heat exchanger 13 or 13'. Brine inlets 10 and 10' disposed in the upper portions of the housings 12 and 12', respectively, supply brine from brine/refrigerant heat exchangers 24 and 24' to a set of drip or spray nozzles or apertures 11 and 11' located directly above the air/brine heat exchangers so that the incoming brine is directed onto the upper ends of the pads. The lower portions of the units 10 and 10' contains brine reservoirs 14 and 14', respectively, for receiving brine exiting the air/brine heat exchangers.

Each of the air/brine heat exchangers 13 and 13' preferably includes a pair of direct contact air/brine heat exchanger pads 13*a* and 13*b*, or 13'*a* and 13'*b*, spaced slightly apart from each other. The pads 13*a* and 13*b* may be pads such as those described in U.S. Patent Publication No. 2003/0003274. It is preferred to use at least two such porous pads in each air/brine heat exchanger, with a vertical gap between the two pads. The cool brine from the brine/refrigerant heat exchanger 24 wets the pads 13*a* and 13*b* and cools the air as the air passes through the air-permeable pads 13*a*, 13*b* in a direction transverse to that of the brine flowing downwardly through the pads by gravity. The gap between the two pads 13*a*, 13*b* may be about 5-10 mm, to prevent the liquid brine from flowing from one pad to another. Thus, the liquid brine in the inner pad 13*b* is cooler than the liquid brine in the outer pad 13*a*, and the cross flow of air through the two pads causes the cooler air passing through the inner pad 13*b* to interact with cooler brine.

The incoming ambient air is drawn into the housing 12 or 12' by an exhaust fan 20 or 20' or by any other natural or forced means. The incoming air enters the heat exchangers 13 and 13' through openings in one of the wide side walls of the housings 12 and 12'. The openings are aligned with the outer pads 13*a* and 13'*a* in the heat exchangers 13 and 13', respectively, and air is drawn through the heat exchangers 13 or 13' by the exhaust fans 20 and 20'. The direct contact air/brine heat exchanger pads 13*a* and 13*b* are spaced from each other in the direction of air flow through the pads. The air is cooled by the brine flowing through the heat exchanger 12 or 12', so that the air discharged from the housing is at a lower temperature, and a lower humidity level, than the ambient air entering the heat exchanger.

Each of the brine inlets 10 and 10' is connected by a conduit 22 or 22' to one of the brine/refrigerant heat exchangers 24 and 24'. Conduits 26 and 26' convey brine to the brine/refrigerant heat exchangers 24 or 24', respectively, from the corresponding brine reservoirs 14 and 14' via circulation pumps 28 and 28'. The brine reservoirs 14 and 14' are also in liquid communication with each other via conduits 30 and 32 and a brine heat exchanger 34.

The brine/refrigerant heat exchangers 24 and 24' are composed of closed vessels 36 and 36' housing coils 38 and 38', respectively. The coils 38 and 38' are interconnected, in a closed loop, by conduits 40 and 42. A compressor 44 in the conduit 40 forces the refrigerant through the closed loop that includes the coils 38 and 38', the conduits 40 and 42, and a throttle valve 46.

In order to avoid the need for synchronization and control between the pumps 28 and 28', the brine accumulated in the reservoir 14' is preferably returned to the reservoir 14 by gravity flow through the conduit 32. This is achieved by locating the reservoir 14' at a higher elevation than the reservoir 14. The brine exchange flow rate between the reservoirs 14 and 14' via conduits 30 and 32 is smaller than the circulation rate of the brine through the air/brine heat exchangers 13 and 13'. For operation under certain conditions, it is also possible to stop the circulation of the brine between the two units, if desired.

Figure 2:
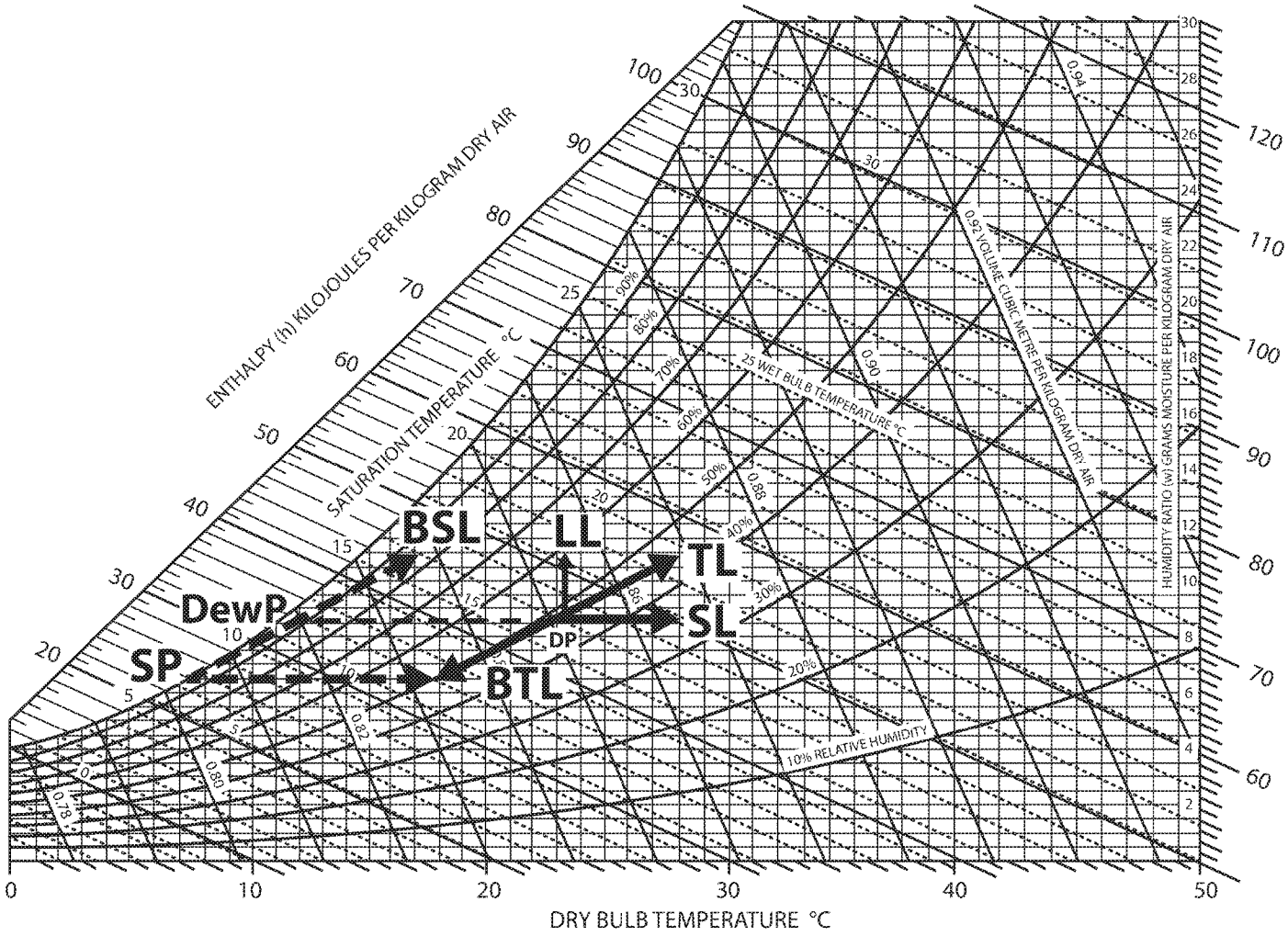
FIG. 2 is a psychrometric diagram illustrating one mode of operation of the system shown in FIG. 1.

FIG. 2 is a psychrometric chart for an air conditioning system designed to keep the air temperature and humidity at a design point DP where:

- the dry bulb temperature is 24° C. (the vertical coordinates with the horizontal scale at the bottom of the chart),
- the vapor concentration is 8.5 grams moisture per kilogram dry air (the horizontal coordinates with the vertical scale at the right side of the chart), and
- the air enthalpy is 46 kilojoules per kilogram (kJ/kg) dry air (the diagonal coordinates with the diagonal scale at the left side of the chart).

The sensible load SL in FIG. 2 is the vector DP-SL (24° C. to 29° C., 51 kJ/kg). The latent load LL is the vector DP-LL (24° C., 51 kJ/kg). The total load TL is the sum of the vectors DP-SL and DP-LL. TL is at a temperature of 29° C., a vapor concentration of 10.5 g/kg and an enthalpy of 56 kJ/kg. Without air conditioning, in a 1000-second time interval the air enthalpy of an enclosure with an air mass of 1000 kg. will change from DP with 46 kJ/kg to TL at 56 kJ/kg. The enclosure load is equivalent to (56-46) kJ/kg*1000 kg/1000 s.=10 kJ/s=10 kW. To keep the enclosure at the design point DP, with the humidity and temperature at steady state, the DP-TL vector must be balanced by the DP-BTL vector, which corresponds to (SL+LL). When dry air at the design point DP is introduced into a conventional air conditioning system, it is cooled to the dew point (Dew P in FIG. 2) without condensation, which keeps the vapor concentration at 8.5 g/kg.

The vector sum of (DP−DewP)+(DP−TL)=(Dew−BSL) in FIG. 2, with exit air at 17° C. and 88% relative humidity (RH). Thus, the 50% RH and 24° C. of the design point DP will be replaced with BSL, which is 88% RH and 17° C.

To balance the enclosure load with conventional air conditioning, the air should be further cooled to the saturated point SP, which is 7.5° C., and a vapor concentration of 6.5 g/kg., and then heated to the point BTL before exiting.

The vapor pressure at the liquid interface follows the relative humidity curve of the refrigerant, e.g., LiCl at a salinity of 25% will follow the 50% relative humidity line in FIG. 2. When enclosure air is at 24° C. and a vapor concentration of 8.5 g/kg, exchange heat and vapor with LiCl at S=25% and a temperature of 15° C. with an interface vapor concentration of 5.5 g/kg, the air vapor will condense on the liquid brine, and the air will fallow the vector DP-BTL, which is a capacity of 10 kW as compared with 22 kW when following the vector DP-DewP-SP with an enthalpy differential of 46−24=22 kJ/kg with a capacity 22 kW, which represents the design point (DP) of the enclosure climate (temperature of 24° C., vapor concentration of 8.5 g/kg, and enthalpy of 46 kJ/kg). The enclosure sensible load SL is the vector DP-SL, the enclosure latent load LL is the vector DP-L with a vapor concentration varied between 8.5 g/kg at DP and 10.5 g/kg at LL. The total load TL is the vector DP-TL (where TL is at a vapor concentration of 10.5 g/kg and a temperature of 29° C.), which is presented in FIG. 2 as the vector sum of DP-SL and DP-LL. To keep DP stead, the air conditioning should balance the vector DP-TL with an enthalpy gradient of (56-46)=10 kJ/kg.

FIG. 2 presents three vectors which balance TL:

1. DP-DewP, where temperature decreases from 24° C. to 12° C., vapor concentration remains 8.5 g/kg and enthalpy varies from 46 to 34 kJ/kg.
2. DewP-SP at temperature of 8.5° C., vapor concentration 6.5 g/kg, and enthalpy of 24 kJ kg.
3. SP-BTL at temperature of 18° C., vapor concentration of 6.5 g/kg and enthalpy of 35 kJ/kg.

DP to DewP is associated with dry cooling. The balancing of the sensible load SL brings DP to BSL where temperature is 17° C. and relative humidity is 88%.

For an enclosure with 1000 kg air where DP temperature is at DP varied to TL in 1000 s, with an air flow of 1 kg/s at HAC, the cooling load is given as:

$$(56-46)\text{kJ/kg}*1000\text{ kg}/(1000\text{ s.})=10\text{ kW}.$$

In the air/brine heat exchanger 13 in FIG. 1, the air loses heat to the cold brine in the pads 13*a* and 13*b*, and that brine then flows into the reservoir 14. The heated brine is pumped from the reservoir 14 by the pump 28 to be cooled at the refrigerant/brine heat exchanger 24. Eq (1) shows that the air flow Ca is determined by the total load TL on the enclosure and the design point DP of air conditioning for a given enclosure:

$$Ca=\text{TL(kW)}/[En(\text{TL})-En(\text{DP})]\text{ kg/s}. \quad (1)$$

Here, Ca is the air flow (kg/s), TL is the total load (kW), En(TL) is the air enthalpy at TL, and En(DP) is the enthalpy at the design point DP. The air cooling capacity Qa is equal to the brine cooling at the refrigerant/brine heat exchanger 24. Thus, the cooling capacity Qa is:

$$Qa=[Ca*(En(\mathrm{Tl})-En(\mathrm{DP})]\ \mathrm{kw} \quad (2)$$

The brine flow Mb is related to the cooling capacity Qa in Eq (3)

$$Mb=Ca*[En(\mathrm{Tl})-En(\mathrm{Dp})]/[Cpb*(Tbr-Tbc)]\ \mathrm{kg/s}, \quad (3)$$

where Cpb is the specific heat of brine.

Eq (3) can be written as:

$$Mb/Ca=\Delta En/(Cpb\Delta Tb) \quad (4)$$

The brine-to-air flow Mb/Ca is related to the temperature gradient ΔTb because ΔEn is determined by load, the design point DP is given in (Eq 1), For a given enclosure with a given load, Eq (4) shows that a large mass ratio Mb/Ca is associated with a small brine temperature gradient.

A large Mb is associated with a large pump (28 in FIG. 1) and enhanced liquid drifts from spray distribution at the brine inlet 10 or the direct contact heat exchangers 12. Tests confirm that for: Mb/Ca>4, the pump 28 power exceeds the practical limit and friction dissipation at the evaporator 4. This enhances brine drift from the brine inlet 10 and the heat exchanger 12. Thus, Eq (5) defines the number 4 as the upper limit on the brine/air mass ratio flow:

$$Mb/Ca<4 \quad (5)$$

On the other hand, a small brine flow rate Mb is associated with a large liquid temperature gradient Tbr−Tbc, which is associated with a large enthalpy gradient at the brine interface. The brine enthalpy at the reservoir 14 must be smaller than the air enclosure enthalpy for the air entering the heat exchanger 12. Otherwise the enclosure air would be heated in the heat exchanger 12. Also, the brine in the reservoir 14 would be warmer than the refrigerant in the evaporator 24.

Thus, the lower limit for the brine-to-air flow ratio is given on the right side of Eq. (6), as follows:

$$Mb/Ca>(En(\mathrm{DP})-En(BTL)/(cpb)*(Ta(enc)-T(\mathrm{Ref})) \quad (6)$$

In Eq (6):

Ca is given in Eq (1), and

En (DP) is determined by the design points.

The load TL=−BTL is given, and thus En(BTL) can be determined from the psychrometric chart in FIG. 2:

Ta (enclosure) is given at the design point.

T (refrigerant) is usually part of the heat pump and evaporator design.

Tests and the limit of Eq (5) show that:

$$0.1<Mb/Ca<4 \quad (7)$$

While particular embodiments, aspects and applications of the present invention have been illustrated and described, it is to be understood that the invention is not limited to the precise construction and compositions disclosed herein and that various modifications, changes and variations may be apparent from the foregoing description without departing from the spirit and scope of the invention as defined in the appended claims.

The invention claimed is:

1. A heat pump system comprising:

a first unit and a second unit in fluid communication with each other, each of the first unit and the second unit including a housing having:

(i) an air/brine heat exchanger including a direct contact air/brine heat exchanger pad, (ii) a brine inlet for supplying liquid brine to the upper end of the air/brine heat exchanger such that the liquid brine flows downwardly through the direct contact air/brine heat exchanger pad, (iii) an air inlet for directing ambient air into the direct contact air/brine heat exchanger pad in a direction transverse to the flow of liquid brine through the direct contact air/brine heat exchanger pad, (iv) an air outlet receiving air passed through said heat exchanger pad and discharging said air from said housing, and (v) a brine reservoir receiving brine passed through said air/brine heat exchanger;

a first brine/refrigerant heat exchanger configured to receive liquid brine from the brine reservoir of the first unit and supply liquid brine to the brine inlet of the first unit, and a second brine/refrigerant heat exchanger configured to receive liquid brine from the brine reservoir of the second unit and supply liquid brine to the brine inlet of the second unit; and a refrigerant supply line coupled to the first brine/refrigerant heat exchanger and the second brine/refrigerant heat exchanger for supplying refrigerant to said the first brine/refrigerant heat exchanger and the second brine/refrigerant heat exchanger, wherein the first unit is configured such that a ratio Mb/Ca of (a) a brine flow rate Mb through the direct contact air/brine heat exchanger pad to (b) an air flow rate Ca through the direct contact heat exchanger pad, is between about 0.1 and about 4.

2. The heat pump system of claim 1, wherein the housing of each of the first unit and the second unit includes an exhaust fan to aid in drawing ambient air through the air/brine heat exchanger.

3. The heat pump system of claim 1, further comprising a first brine pump coupled to the brine reservoir of the first unit, the first brine pump being configured to aid in supplying liquid brine from brine reservoir of the first unit to the first brine/refrigerant head exchange, and a second brine pump coupled to the brine reservoir of the second unit, the second brine pump being configured to aid in supplying liquid brine from the brine reservoir of the second unit to the second brine/refrigerant heat exchanger.

4. The heat pump system of claim 1, wherein the direct contact air/brine heat exchanger pad of each of the first unit and the second unit are porous pads that are (a) configured to be wetted by liquid brine flowing through the pads and (b) permeable to ambient air that is drawn or forced through the pads to aid in exchanging heat between the liquid brine and the ambient air.

5. The heat pump system of claim 1, wherein the brine inlet of the first unit is configured to spray liquid brine onto the upper end of the direct contact air/brine heat exchanger pad of the first unit.

6. The heat pump system of claim 1, wherein the air/brine heat exchanger of each of the first unit and the second unit includes a pair of direct contact air/brine heat exchanger pads spaced from each other in the direction of air flow through said pads.

7. The heat pump system of claim 1, further comprising a brine heat exchanger including a first conduit configured to conduct liquid brine from the brine reservoir of the first unit to the brine reservoir of the unit and a second conduit configured to conduct liquid brine from the brine reservoir of the second unit to the brine reservoir of the first unit.

8. A heat pump method comprising:

supplying liquid brine to an upper end of an air/brine heat exchanger pad of a first unit such that the liquid brine flows downwardly through the air/brine heat exchanger pad;

directing ambient air into the air/brine heat exchanger pad in a direction transverse to the flow of liquid brine through the air/brine heat exchanger pad;

receiving air passed through said heat exchanger pad and discharging said air from said housing;

receiving, in a brine reservoir, liquid brine passed through the air/brine heat exchanger;

supplying liquid brine from the brine reservoir to a brine/refrigerant heat exchanger; and supplying refrigerant to the brine/refrigerant heat exchanger, wherein the first unit is configured such that a ratio Mb/Ca of (a) a brine flow rate Mb through the air/brine heat exchanger pad to (b) an air flow rate Ca through the air/brine heat exchanger pad, is between about 0.1 and about 4.

9. A heat pump method for controlling the temperature and humidity of the air in an enclosure, the method comprising:

supplying liquid brine to an upper end of a first direct contact air/brine heat exchanger within a first housing located in said enclosure such that the liquid brine flows downwardly through the first direct contact air/brine heat exchanger;

directing ambient air in said enclosure into said first direct contact air/brine heat exchanger in a direction transverse to the flow of liquid brine through the first direct contact air/brine heat exchanger;

wherein a ratio Mb/Ca of (a) a brine flow rate Mb through the first direct contact air/brine heat exchanger to (b) an air flow rate Ca through the first direct contact heat exchanger, is between about 0.1 and about 4;

discharging air passed through the first direct contact air/brine heat exchanger from the first housing into a space within the enclosure;

receiving liquid brine passed through the first direct contact air/brine heat exchanger in a first brine reservoir within the first housing;

supplying liquid brine to an upper end of a second direct contact air/brine heat exchanger within a second housing located outside the enclosure such that the liquid brine flows downwardly through said second direct contact air/brine heat exchanger;

directing ambient air from outside the enclosure into the second direct contact air/brine heat exchanger in a direction transverse to the flow of liquid brine through the second direct contact air/brine heat exchanger discharging air passed through said second direct contact air/brine heat exchanger from the second housing into the space outside the enclosure;

receiving liquid brine passed through the second direct contact air/brine heat exchanger in a second brine reservoir within the second housing;

supplying liquid brine from the first brine reservoir of the first housing to a first brine/refrigerant heat exchanger coupled directly to the first housing;

supplying liquid brine from the second brine reservoir of the second housing to a second brine/refrigerant heat exchanger coupled directly to the second housing; and supplying refrigerant to the first brine/refrigerant head exchanger and the second brine/refrigerant heat exchanger.

10. The heat pump method of claim 9, wherein each of the first housing and the second housing includes an exhaust fan to aid in drawing ambient air through the first direct contact air/brine heat exchanger and the second direct contact air/brine heat exchanger.

11. The heat pump method of claim 9, wherein a refrigerant supply line is coupled to the first brine/refrigerant heat exchanger and the second brine/refrigerant heat exchanger for supplying refrigerant thereto.

12. The heat pump method of claim 9, wherein (i) a first brine pump is coupled to the first brine reservoir of the first housing, the first brine pump being configured to supply liquid brine from the first brine reservoir to the first brine/refrigerant heat exchanger and (ii) a second brine pump is coupled to the second brine reservoir of the second housing, the second brine pump being configured to supply liquid brine from the second brine reservoir to the second brine/refrigerant heat exchanger.

13. The heat pump method of claim 9, wherein each of the first direct contact air/brine heat exchanger and the second direct contact air/brine heat exchanger include a heat exchanger pad, the heat exchanger pad being porous such that the pad (i) can be wetted by liquid brine flowing through the pad and (ii) is permeable to air that is drawn or forced through the pad, to aid in exchanging heat between the liquid brine and the air.

14. The heat pump method of claim 9, wherein a first brine inlet of the first housing sprays liquid brine onto the upper end of the first direct contact air/brine heat exchanger and a second brine inlet of the second housing sprays liquid brine onto the upper end of the second direct contact air/brine heat exchanger.

15. The heat pump method of claim 9, wherein each of the first direct contract air/brine heat exchanger and the second direct contact air/brine heat exchanger includes a pair of spaced direct contact air/brine heat exchanger pads spaced from each other in the direction of air flow through the direct contact air/brine heat exchanger pads.

16. The heat pump method of claim 9, further comprising conducting liquid brine from the first brine reservoir of the first housing to the second brine reservoir of the second housing through a brine heat exchanger; and conducting brine from the second brine reservoir of the second housing to the first brine reservoir of the first housing through the brine heat exchanger.

* * * * *